US005137392A

United States Patent [19]

McCoy

[11] Patent Number: 5,137,392

[45] Date of Patent: Aug. 11, 1992

[54] CIRCULAR PAVING STONE ARRANGEMENT

[76] Inventor: John R. McCoy, 28 Woodbridge Cir., General Delivery, Ashburn, Ontario, Canada, L0B 1A0

[21] Appl. No.: 676,435

[22] Filed: Mar. 28, 1991

[30] Foreign Application Priority Data

Jan. 14, 1991 [CA] Canada ..... 2034119

[51] Int. Cl.[5] ..... E01C 5/00

[52] U.S. Cl. ..... 404/42

[58] Field of Search ..... 404/41, 42, 34, 38

[56] References Cited

U.S. PATENT DOCUMENTS

| | | | |
|---|---|---|---|
| 4,496,266 | 1/1985 | Ruckstuhl | 404/41 |
| 4,572,699 | 2/1986 | Rinninger | 404/42 |
| 4,907,909 | 3/1990 | Ruckstuhl | 404/42 X |

FOREIGN PATENT DOCUMENTS

| | | | |
|---|---|---|---|
| 182052 | 2/1918 | Canada . | |
| 2615876 | 12/1988 | France | 404/42 |
| 117121 | 6/1926 | Switzerland | 52/315 |

*Primary Examiner*—William P. Neuder

*Attorney, Agent, or Firm*—Dressler, Goldsmith, Shore, Sutker & Milnamow, Ltd.

[57] ABSTRACT

A circular paving stone arrangement is disclosed employing five discrete shapes of molded paving blocks. Two of the molded paving blocks have novel fan-shaped or wedge-shaped forms and are adapted to be used with square, circular, and rectangular blocks in a predetermined sequence in the construction of a unique circular paving stone arrangement. The gap between adjacent sides of adjacent blocks in minimal and thereby reduces any possibility of injury to person or footwear.

6 Claims, 2 Drawing Sheets

CIRCULAR PAVING STONE ARRANGEMENT

FIELD OF THE INVENTION

This invention relates to molded paving stones and, in particular, to a circular paving stone arrangement.

BACKGROUND

In the past, circular arrangements or patterns of paving stones have been made by craftsmen employing cutting and shaping tools on natural stone. In today's world however, the assembly of a paving stone arrangement is this manner is far too costly and labour intensive. Today's paving stones are generally pre-cast concrete or some other material made in molds of discrete forms.

To date no one has been able to construct a circular paving stone arrangement without having large gaps between adjacent sides of some of the paving stones. The problems associated with large gaps between adjacent sides of paving stones are two fold. Firstly, the sand or other particulate filler placed between the paving stones during construction is easily washed away by rain, snow and wind. Secondly, various bodily injuries have occurred particularly to persons wearing slim high-heeled shoes which get caught in the gaps between adjacent stones. Thus municipalities, public buildings and the like, in recent years, have been reluctant to use circular paving stone arrangements because the gaps between the paving stones are a potential source of liability.

It is possible to form a circular paving arrangement using dozens of different shaped blocks wherein the gap between adjacent sides is reduced. However, the cost and complexity of not only producing the molds for dozens of such blocks, but also the costs of arranging them in the correct sequence is overwhelming.

Thus, it is an object of the present invention to produce a circular paving stone arrangement using a minimal number of shapes of paving stones which can be assembled quickly and easily by a workman with minimal skills.

It is a second object of the present invention to provide two new fan-shaped paving stones which will permit the assembly of a circular paving pattern.

It is a further object of the present invention to provide a circular paving stone arrangement wherein the gaps between adjacent sides of adjacent blocks or stones are minimal so as to prevent injury to pedestrians, and more particularly, to persons wearing high-heeled footwear.

SUMMARY OF THE INVENTION

In order to construct the circular arrangement of the present invention it is necessary to use several discrete shaped blocks. It is evident to the man skilled in the art that the central block will, of course, be comprised of one round block or two substantially semi-circular blocks and this is known. Other known blocks which are used are rectangular and square. In addition to the three known blocks, two new fan-shaped blocks are used.

Therefore, this invention seeks to provide a molded paving block for use with rectangular shaped blocks in the construction of a circular paving block arrangement; said molded paving block being one of two substantially fan-shaped forms provided with at least one multi-angled edge such that on assembly into said circular arrangement with said rectangular shaped blocks, the gap between adjacent edges of adjacent blocks is a predetermined distance.

The invention further seeks to provide a molded paving block wherein, a first of said fan-shaped blocks comprises inner and outer arcuate edges of different radii of curvature joined by radial side edges; said outer arcuate edge having a flattened mid-portion extending substantially over the majority of said arcuate outer edge.

The invention further seeks to provide a molded paving block wherein, a second fan-shaped block comprises an inner and outer arcuate edge of the same radii of curvature joined by substantially radial side edges; each side edge being deflected uniformly inwardly near its mid-point, whereby said edges are not of straight line configuration.

In a preferred embodiment of the present invention the circular paving arrangement is constructed using a central round paving block or two substantially semi-circular blocks surrounded by nine annular rings of paving stones. In each successive annular ring away from the central stone, more blocks are added and different configurations of the four other different shaped blocks are employed. The paving stone arrangement of the present invention may use blocks having chamfered side edges such that the area of the top face of each block is less than the area of the bottom face.

The arrangement of the present invention is very compact and, indeed, there are no gaps between adjacent edges of any of the paving blocks which are greater than 8 mm.

Therefore, in a preferred embodiment, this invention provides a method of constructing a circular paving arrangement from paving blocks of five discrete shapes in a predetermined pattern including the placement of:

a central round paving block or two substantially semicircular blocks at the center point of said circular paving arrangement;

a first annulus of first fan-shaped blocks having inner and outer arcuate edges, wherein the outer arcuate edge is flattened in the mid-portion thereof, surrounding said first round paving block;

a second annulus comprised of said first fan-shaped blocks interspersed with rectangular blocks;

a third and fourth annuli comprised of second fan-shaped blocks, said blocks having arcuate inner and outer edges and substantially radial side edges; said side edges being deflected inwardly at substantially their mid-points such that said edges are not of straight line configuration;

a fifth and sixth annuli comprised of rectangular blocks and said second fan-shaped paving blocks interspersed with one another;

a seventh annulus comprised of rectangular blocks, said second fan-shaped blocks, and square paving blocks interspersed with one another; and an eighth and ninth annuli comprised of said second fan-shaped blocks interspersed with said square paving blocks.

BRIEF DESCRIPTION OF THE DRAWINGS

The invention is more particularly described in connection with the following drawings which illustrate a preferred embodiment wherein.

DETAILED DESCRIPTION OF THE INVENTION

Figure 1:
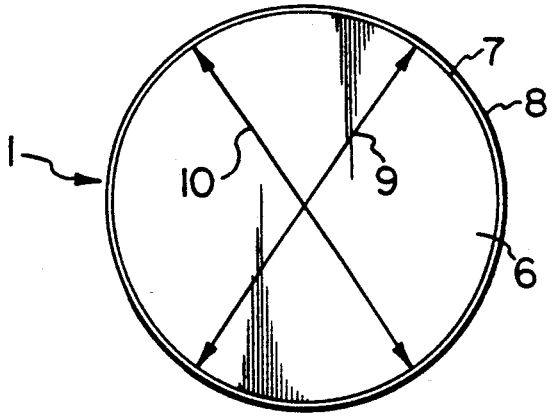
FIG. 1 is a top view of a round paving stone.

In FIG. 1 the central paving block 1 is shown having a top face 6 and a top circumferal edge 7 and a lower circumferal edge 8. This round block can also be comprised of two substantially semi-circular blocks. The arrow indicated by 9, in a preferred embodiment, shows a distance being the diameter of the lower face (not shown) of 165 mm. The arrow indicated as 10, being the diameter between the edges of the top face 6, is in a preferred embodiment, 162 mm. Thus, the round stone has chamfered edges. The stone 1 is used at the center of the paving arrangement. It should be noted that all of the blocks shown in the subsequent figures have chamfered edges but this is not essential to the invention.

Figure 2:
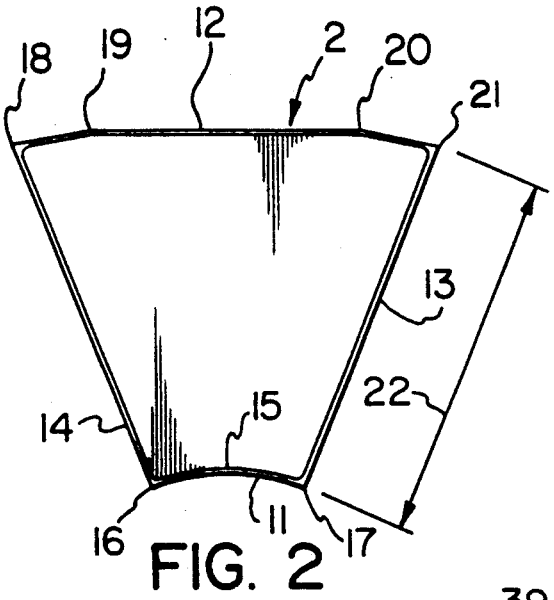
FIG. 2 is a top view of a first fan-shaped paving stone.

In FIG. 2 is shown a first fan-shaped block 2. It has an inner arcuate edge 11 and an outer arcuate edge 12 and two substantially straight radial side edges 13 and 14. The curvature of edge 11 is greater than that of outer arcuate edge 12. Outer arcuate edge 12 is flattened between points 19 and 20.

The mid-point of inner arcuate edge 11 is marked as 15 and the left and right corners of inner arcuate edge 11 are marked as 16 and 17. It should be noted that the distance of a chord drawn between mid-point 15 and corner 17 on inner arcuate edge 11 is equal to the distance of a chord drawn between point 20 and corner 21 of outer arcuate edge 12. Similarly, the distance of a chord drawn between mid-point 15 and left corner 16 of inner arcuate edge 11 is equal to the distance of a chord drawn points 18 and 19 on outer arcuate edge 12.

Finally, the length of each of the sides 13, 14, shown as arrow 22, in a preferred embodiment, is 150 mm. One will note in subsequent drawings that this is substantially equal to the sides of the remaining blocks (to be discussed in subsequent paragraphs).

Figure 3:
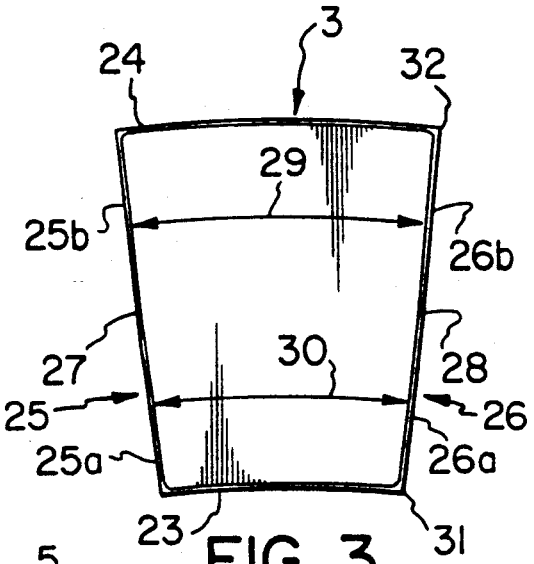
FIG. 3 is a top view of a second fan-shaped paving stone.

In FIG. 3 the second and the smaller of the fan-shaped blocks 3 of the present invention is shown from a top view. The block has an inner arcuate edge 23 and an outer arcuate edge 24, and two radial side edges 25 and 26. These radial side edges are not straight lines but deflect inwardly at their approximate mid-points 27 and 28, respectively. Thus the angle subtended between upper left side 25*b* and upper right side 26*b*, and shown as 29, is 11.25° whereas the angle of curvature between lower left side 25*a* and lower right side 26*a*, shown as 30, is 15°.

The curvature of inner arcuate edge 23 and outer arcuate edge 24 is substantially similar, that is to say the center point of the radius of each of the two arcuate edges differs by approximately the length of sides 25 or 26. The angle subtended between the end points of arrow 30, which is 15°, is important in that in one annular ring of the circular paving arrangement of the present invention twenty-four of the small fan-shaped blocks 3 will form a complete circular annulus of 360°, whereas, the upper smaller subtended angle 29 will form a subsequent 360° annular ring when thirty-two blocks are used. It is also important to note that the distance between 31 and 32, i.e. the length of right radial side edge 26 and left radial side edge 25, is 150 mm, identical to the length of radial side edges of the larger first fan-shaped blocks shown in FIG. 2.

Figure 4:
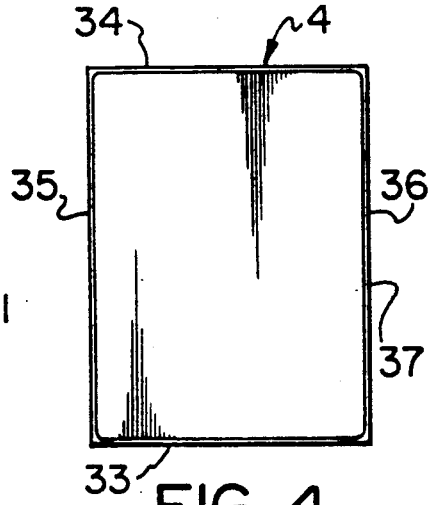
FIG. 4 is a top view of a rectangular paving stone.

In FIG. 4 is shown a rectangular block 4 which has one end 33, another end 34 and left and right sides 35 and 36, respectively. The edges of the block may be chamfered as shown as chamfer 37. In a preferred embodiment the sides 35 and 36 are 150 mm long while the ends 33 and 34 are 112 mm wide. Again it is to be noted that the sides 35 and 36 are of the same length as the radial side edges of the two fan-shaped blocks shown in FIGS. 2 and 3.

Figure 5:
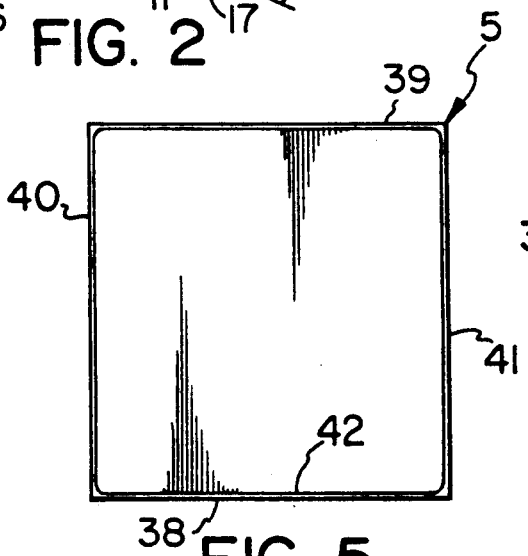
FIG. 5 is a top view of a square paving stone.

FIG. 5 is a top view of a square block 5 having equal distant sides 38, 39, 40 and 41 in a preferred embodiment. The edges of the block are chamfered as shown by 42 such that the bottom face has equal distant sides in a preferred embodiment of 150 mm, similar to the length of the sides of the blocks shown in FIGS. 2, 3 and 4.

Figure 6:
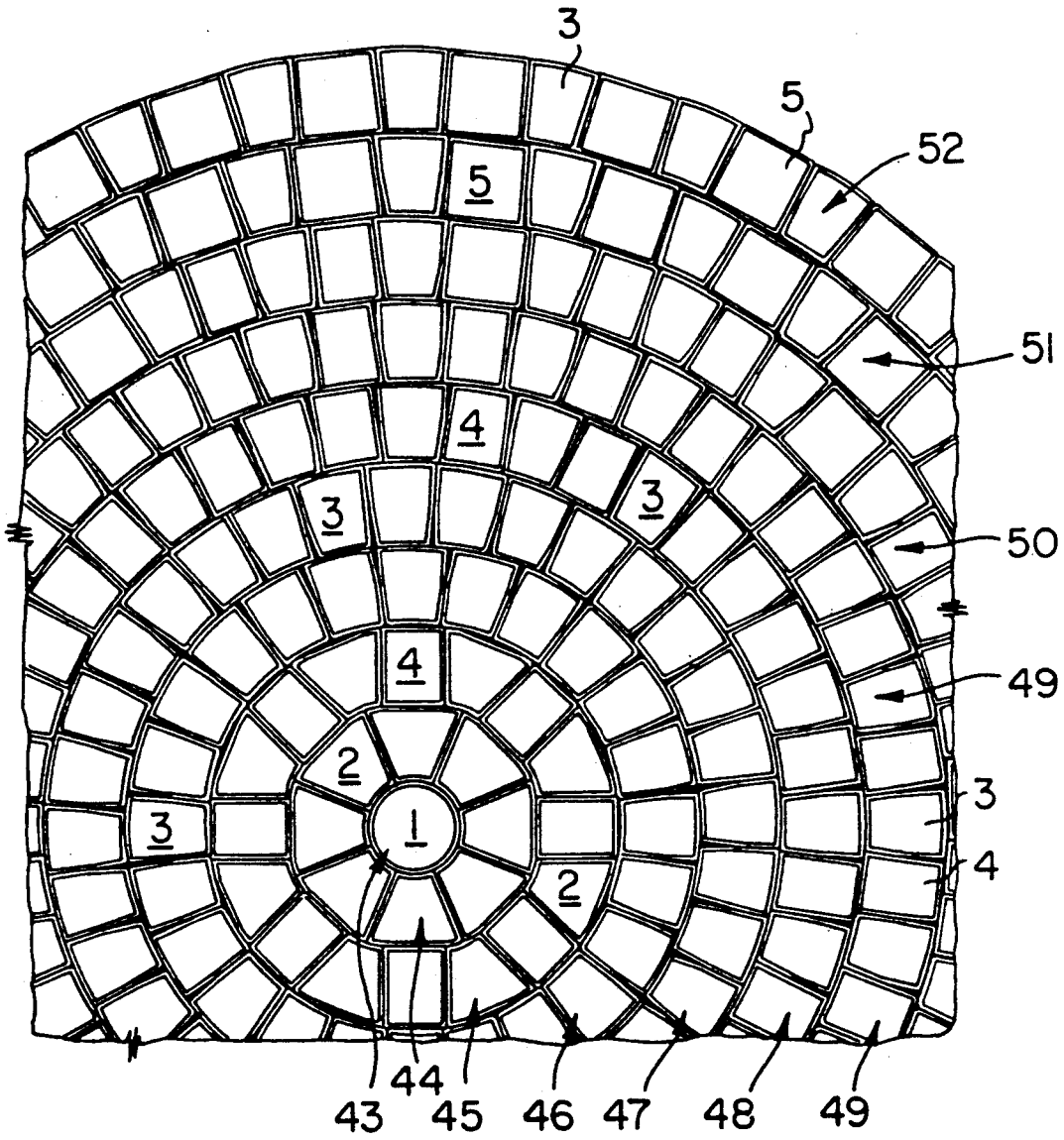
FIG. 6 is a top view of a major portion of a circular paving arrangement made according to the present invention.

In FIG. 6 one sees a partial top view of the circular paving arrangement of the present invention. Examples of round block 1, large fan-shaped block 2, small fan-shaped block 3, rectangular block 4 and square block 5, are indicated.

To construct the circular paving arrangement of the present invention one begins with a round block 1 (or two substantially semi-circular blocks, not shown), indicated as 43. Nine annular rings or circles of blocks surround the round block 1. The nine concentric annular rings of blocks are marked as 44 to 52, respectively.

The first annular ring marked as 44 is comprised of eight large fan-shaped stones 2.

The second annular ring marked as 45 is comprised of eight large fan-shaped blocks 2 and eight rectangular blocks 4.

The third annular ring marked as 46 is comprised of twenty-four small fan-shaped blocks 3, whereas the fourth annular ring of paving blocks, marked as 47, is comprised of thirty-two small fan-shaped blocks 3.

The fifth annular ring of blocks marked as 48, is comprised of rectangular blocks 4 and small wedge-shaped blocks 3. The two different blocks are interspersed with one another and a total of twenty small fan-shaped blocks and twenty rectangular blocks are used.

The sixth annular ring of blocks marked as 49, is again comprised of small fan-shaped blocks 3 and rectangular blocks 4, interspersed with one another. There are 24 small fan-shaped blocks and 24 rectangular blocks in the ring.

The seventh annular ring of blocks marked as 50 is comprised of small fan-shaped blocks 3, rectangular blocks 4 and square blocks 5. In total twenty-seven small fan-shaped blocks, eighteen rectangular blocks, and nine square blocks are used.

In the eighth annular ring of paving blocks marked as 51, small fan-shaped blocks are interspersed with square blocks. In total there are twenty-eight small fan-shaped blocks 3 and twenty-eight square blocks 5.

In the outer ninth annular ring of paving blocks marked as 52, small fan-shaped blocks 3 are again interspersed with square blocks 5. There are thirty-two small fan-shaped blocks 3 and thirty-two square blocks 5 in the final annular ring.

One particular embodiment of the circular paving arrangement of the present invention using the five discrete shapes of blocks has been described. Other combinations are possible and any alterations to the preferred embodiment described herein using five or less of the discrete forms are deemed to be part of the present invention.

What I claim as my invention is:

1. A method of constructing a circular paving arrangement from paving blocks of five discrete shapes in a predetermined pattern including the placement of:

a central round paving block or two substantially semicircular blocks at the center point of said circular paving arrangement;

a first annulus of first fan-shaped blocks having inner and outer arcuate edges, wherein the outer arcuate edge is flattened in the mid-portion thereof, surrounding said first round paving block;

a second annulus comprised of said first fan-shaped blocks interspersed with rectangular blocks;

a third and fourth annuli comprised of second fan-shaped blocks, said blocks having arcuate inner and outer edges and substantially radial side edges; said side edges being deflected inwardly at substantially their mid-points such that said edges are not of straight line configuration;

a fifth and sixth annuli comprised of rectangular blocks and said second fan-shaped paving blocks interspersed with one another;

a seventh annulus comprised of rectangular blocks, said second fan-shaped blocks, and square paving blocks interspersed with one another; and an eighth and ninth annuli comprised of said second fan-shaped blocks interspersed with said square paving blocks.

2. A method as claimed in claim 1 wherein an equal number of blocks are arranged in each of said annuli.

3. A molded paving block for use with rectangular-shaped blocks in the construction of a circular paving block arrangement, said molded paving block being one of two substantially fan-shaped forms provided with at least one multi-angled edge wherein a first of said fan-shaped blocks comprises:

inner and outer arcuate edges of different radii of curvature joined by radial side edges;

said outer arcuate edge having a flattened mid-portion extending substantially over the majority of said arcuate outer edge, whereby the chord of each of a left arcuate portion and a right arcuate portion, which are respectively located on either side of said flattened portion of said outer arcuate edge, is equal in length to the chord of ½ of said inner arcuate edge.

4. A molded paving block for use with rectangular-shaped blocks in the construction of a circular paving block arrangement, said molded paving block being one of two substantially fan-shaped forms provided with at least one multi-angled edge wherein a first of said fan-shaped blocks comprises:

an inner and outer arcuate edges of different radii of curvature joined by radial side edges;

said outer arcuate edge having a flattened mid-portion extending substantially over the majority of said arcuate outer edge, whereby the chord of each of a left arcuate portion and a right arcuate portion, which are respectively located on either side of said flattened portion of said outer arcuate edge, is equal in length to the chord of ½ of said inner arcuate edge;

and a second of said fan-shaped blocks comprises:

an inner and an outer arcuate edge of the same radii of curvature joined by substantially radial side edges;

each side edge being deflected uniformly inwardly near its mid-point, whereby said side edges are not of straight line configuration.

5. A molded paved block for use with rectangular-shaped blocks in the construction of a circular paving block arrangement, said molded paving block being one of two substantially fan-shaped forms provided with at least one multi-angled edge wherein a first of said fan-shaped blocks comprises:

inner and outer arcuate edges of different radii of curvature joined by radial side edges;

said outer arcuate edge having a flattened mid-portion extending substantially over the majority of said arcuate outer edge, whereby the chord of each of a left arcuate portion and a right arcuate portion, which are respectively located on either side of said flattened portion of said outer arcuate edge, is equal in length to the chord of ½ of said inner arcuate edge;

and a second of said fan-shaped blocks comprises:

an inner and an outer arcuate edge of the same radii of curvature joined by substantially radial side edges;

each side edge being deflected uniformly inwardly near its mid-point, such that the angle subtended by said side edges below said mid-point is 15° and the angle subtended by said side edges above said mid-point is 11.25°, whereby said side edges are not of straight line configuration.

6. A circular paving arrangement including molded paving blocks of two substantially fan-shaped forms provided with at least one multi-angled edge wherein a first of said fan-shaped blocks comprises:

inner and outer arcuate edges of different radii of curvature joined by radial side edges;

said outer arcuate edge having a flattened mid-portion extending substantially over the majority of said arcuate outer edge, and the chord of each of a left arcuate portion and a right arcuate portion, which are respectively located on either side of said flattened portion of said outer arcuate edge, is equal in length to the chord of ½ of said inner arcuate edge;

and wherein a second of said fan-shaped blocks comprises:

an inner and an outer arcuate edge of the same radii of curvature joined by substantially radial side edges;

each side edge being deflected uniformly inwardly near its mid-point, whereby said side edges are not of straight line configuration;

said circular paving arrangement comprising:

a central round paving block and nine circumferential annuli of increasing radii wherein:

a first annulus consists of eight of said first fan-shaped blocks;

a second annulus consists of eight of said first fan-shaped blocks and eight rectangular blocks;

a third annulus consists of twenty-four of said second fan-shaped blocks;

a fourth annulus consists of thirty-two of said second fan-shaped blocks;

a fifth annulus consists of twenty of said second fan-shaped blocks and twenty of said rectangular blocks;

a sixth annulus consists of twenty-four of said second fan-shaped blocks and twenty-four of said rectangular blocks;

said outer arcuate edge having a flattened mid-portion extending substantially over the majority of said arcuate outer edge, and the chord of each of a left arcuate portion and a right arcuate portion, which are respectively located on either side of said flattened portion of said outer arcuate edge, is equal in length to the chord of ½ of said inner arcuate edge;

and wherein a second of said fan-shaped blocks comprises:

an inner and an outer arcuate edge of the same radii of curvature joined by substantially radial side edges;

each side edge being deflected uniformly inwardly near its mid-point, whereby said side edges are not of straight line configuration;

said circular paving arrangement comprising:

a central round paving block and nine circumferential annuli of increasing radii wherein a first annulus consists of eight of said first fan-shaped blocks;

a second annulus consists of eight of said first fan-shaped blocks and eight rectangular blocks;

a third annulus consists of twenty-four of said second fan-shaped blocks;

a fourth annulus consists of thirty-two of said second fan-shaped blocks;

a fifth annulus consists of twenty of said second fan-shaped blocks and twenty of said rectangular blocks;

a sixth annulus consists of twenty-four of said second fan-shaped blocks and twenty-four of said rectangular blocks;

a seventh annulus consists of twenty-seven of said second fan-shaped blocks, eighteen of said rectangular blocks, and nine square blocks;

an eighth annulus consists of twenty-eight of said second fan-shaped blocks and twenty-eight of said square blocks; and a ninth annulus consists of thirty-two of said second fan-shaped blocks and thirty-two of said square blocks.

* * * * *

UNITED STATES PATENT AND TRADEMARK OFFICE

CERTIFICATE OF CORRECTION

PATENT NO. : 5,137,392

DATED : August 11, 1992

INVENTOR(S) : John R. McCoy

It is certified that error appears in the above-identified patent and that said Letters Patent is hereby corrected as shown below:

In claim 6, delete Column 7, line 1 to Column 8, line 10.

Signed and Sealed this

Twelfth Day of January, 1993

*Attest:*

DOUGLAS B. COMER

*Attesting Officer*

*Acting Commissioner of Patents and Trademarks*